United States Patent [19]

Campbell

[11] Patent Number: 4,688,610

[45] Date of Patent: Aug. 25, 1987

[54] APPARATUS FOR DISPENSING PARTICULATE AGGLOMERATING SOLIDS

[75] Inventor: Jeptha E. Campbell, Cincinnati, Ohio

[73] Assignee: Spiral Systems Inc., Cincinnati, Ohio

[21] Appl. No.: 713,697

[22] Filed: Mar. 19, 1985

[51] Int. Cl.[4] ..... B65B 1/34

[52] U.S. Cl. ..... 141/83; 141/128; 141/69; 177/120; 198/505; 222/77

[58] Field of Search ..... 141/83, 128, 69, 71, 141/72, 1, 11, 12, 95, 94; 177/105, 116, 119, 120, 25; 198/502.1, 505; 222/161, 63, 56, 77

[56] References Cited

U.S. PATENT DOCUMENTS

| | | | |
|---|---|---|---|
| 3,191,642 | 6/1965 | Saito | 141/128 |
| 3,255,570 | 6/1966 | Weimer | 141/108 X |
| 3,511,871 | 6/1971 | Forman | 198/505 |
| 3,578,094 | 5/1971 | Henry et al. | 177/108 |
| 3,648,741 | 3/1972 | Croasdale et al. | 141/83 X |
| 3,707,172 | 12/1972 | Obara | 141/83 X |
| 3,945,814 | 3/1976 | Keib et al. | 177/119 X |
| 3,970,159 | 7/1976 | Hahn | 141/128 X |
| 3,985,266 | 10/1976 | Wright, Jr. | 177/120 |
| 4,345,628 | 8/1982 | Campbell et al. | 141/83 |
| 4,381,545 | 4/1983 | Biddle, III et al. | 177/116 X |
| 4,469,146 | 9/1984 | Campbell et al. | 141/9 |

FOREIGN PATENT DOCUMENTS

| | | | |
|---|---|---|---|
| 3035592 | 4/1981 | Fed. Rep. of Germany | 141/83 |
| 1549790 | 8/1979 | United Kingdom | 141/83 |

*Primary Examiner*—Stephen Marcus
*Assistant Examiner*—Ernest G. Cusick
*Attorney, Agent, or Firm*—Antonelli, Terry & Wands

[57] ABSTRACT

An apparatus for dispensing particulate agglomerating solids in accordance with the invention includes a container for holding the particulate solids to be dispensed having a foraminous discharge disposed at the bottom of the container; apparatus for applying agitation to the particulate solids within the container to break up agglomerations to cause the solid to be free flowing through the foraminous discharge; a transporting mechanism disposed beneath the discharge with a top surface along which the solids flow from a receiving area upon which the solids fall upon the application of agitation to the solids to a discharge area having an end from which the solids are discharged, the top surface being substantially flat at the receiving area and being sloped downward from the receiving area to the discharge area; apparatus for applying vibrations to the transporting mechanism for causing the solids to flow from the receiving area to the discharge area; and a controller for causing the activation of the apparatus for applying agitation and the apparatus for applying vibrations during the time which the flow of solids occurs from the container along the transporting mechanism with respective power levels which cause the depth of accumulation in the discharge area to not be substantially greater than the depth of accumulation in the receiving area.

6 Claims, 8 Drawing Figures

FIG. 1.
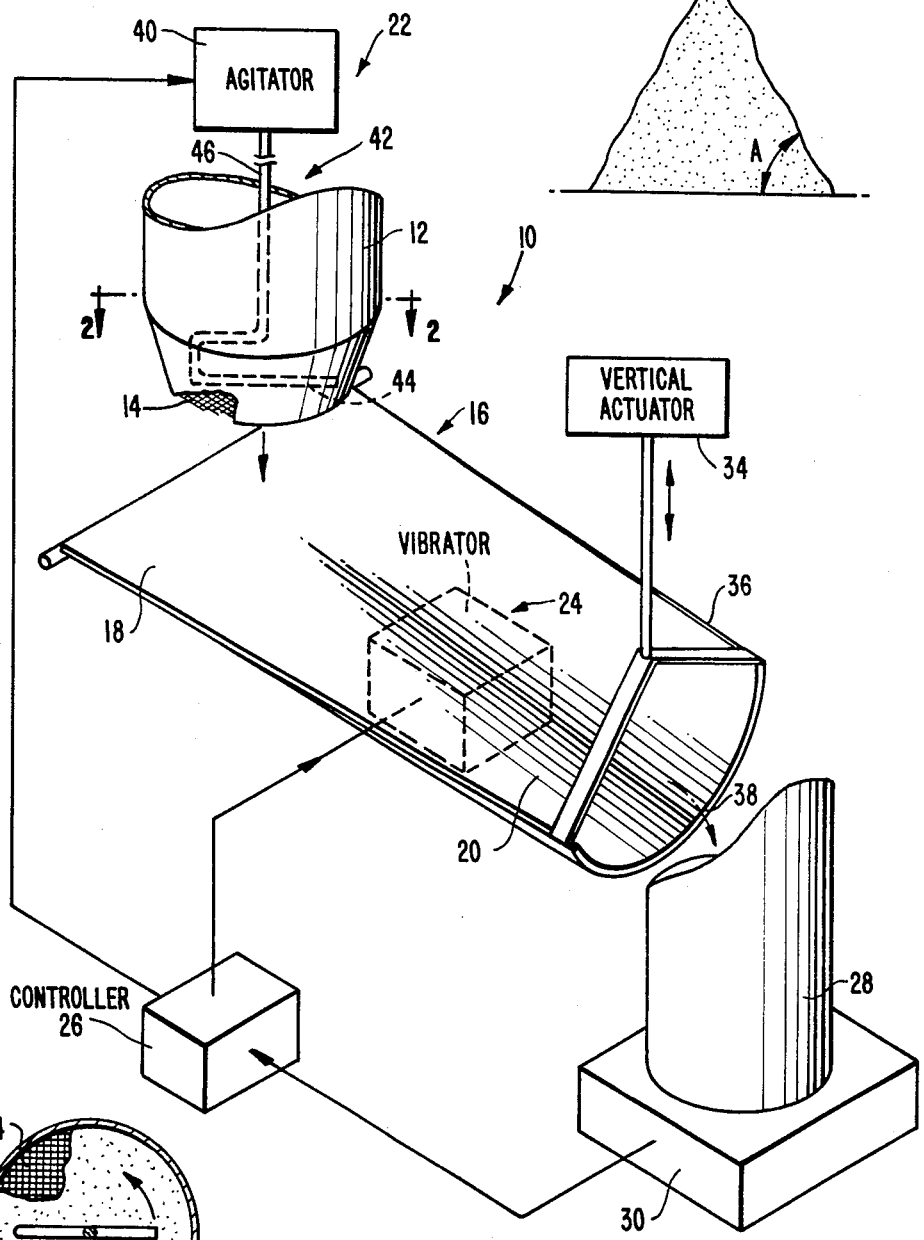
FIG. 1a.
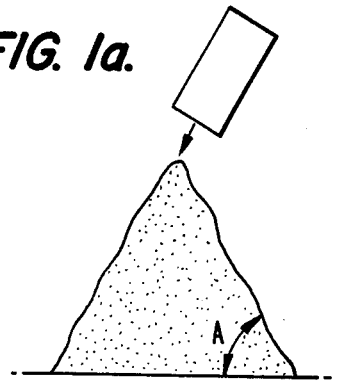
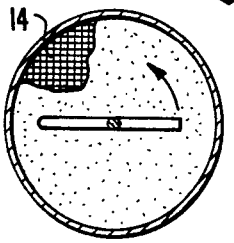
FIG. 2.

* C=PREDETERMINED NUMBER<1

* C=PREDETERMINED NUMBER<1

APPARATUS FOR DISPENSING PARTICULATE AGGLOMERATING SOLIDS

BACKGROUND OF THE INVENTION

1. Field of the Invention

The present invention relates to apparatus for dispensing particulate solids which agglomerate together to prevent free flow in precisely metered quantities.

2. Description of the Prior Art

It has been known that particulate solids may be emptied from a container by inclining the container to a vertical orientation at which the particles break loose and flow under the influence of gravity. Flowing of the solid continues until the vertical angle of inclination is reduced to a point at which frictional forces between the individual particles within the solid cause the particles to bridge together. The problem with dispensing free flowing solids with the aforementioned method is that it is impossible to precisely meter the flow rate once the individual particles have started to flow. Moreover, it is difficult to stop the flow of solids precisely after a predetermined or desired weight of solid has been dispensed from the container.

The foregoing method is even more difficult to use with dispensing solids in which the individual particles readily agglomerate together to form bridges which prevent flow. The agglomerating property makes it much more difficult to initially break apart the bridging of the individual particles. Moreover, once free flow has started, the property which causes agglomeration makes it difficult or impossible to maintain a uniform flow rate and to stop the flow of solids at a precise point.

Systems are also known for dispensing particulate solids from conical-shaped hoppers by the application of an agitating force with sufficient energy to cause the free flow of the solid out of the bottom of a conical hopper. Systems of this type are disclosed in U.S. Pat. Nos. 3,178,068, 3,323,492, 3,270,463, 3,278,081, 3,785,529 and 3,791,558. None of the systems disclosed in the aforementioned patents provides a mechanically simple system for precisely metering the flow rate of particulate solids.

U.S. Pat. No. 3,865,278 discloses a laboratory feeding device for particulate material. A vertically disposed tube is connected to a container of a particulate material by means of a coupling at which a screen is located through which the particulate material falls into a feeding trough which moves the material to a discharge end thereof under the influence of applied vibrations. This system is not satisfactory for dispensing solids which tend to agglomerate for the reason that the transporting mechanism has a V-shaped cross section which concentrates the particulate solids into a confined area which promotes agglomeration of particulate substances which tend to agglomerate and prevents the dispensing of a precise weighed amount. Moreover, the disclosed system does not have any mechanism for reducing the rate of flow for precisely metering of the weight being dispensed at the end of a dispensing cycle.

Solution preparing devices are disclosed in U.S. Pat. Nos. 4,345,628, 4,350,186, and 4,469,146 which meter the weight of a dispensed liquid to be used in preparing a desired type of solution. A total weight of the desired solution including the liquid to be dispensed is calculated. The dispensing of the liquid is stopped when the actual weight of the solution equals the calculated weight. The rate of dispensing of the liquid is reduced when the actual weight approaches the desired weight to facilitate the stopping of dispensing at precisely the calculated weight.

SUMMARY OF THE INVENTION

The present invention is an apparatus for dispensing particulate solids which tend to agglomerate together which has few moving parts and has the capability of precisely controlling the flow of particulate agglomerating solids from a container to permit dispensing in precisely weighed, programmed amounts. While the invention is not limited to any particular field of application, it is particularly useful for accurately dispensing small weights of particulate agglomerating solids typical of those required for work in scientific laboratories.

Without being limited thereto, particulate agglomerating solids which have an "angle of repose" of approximately 40° or more are substances in which the individual particles readily bridge together to form agglomerations which are not readily broken apart to become free flowing without the application of agitation thereto by vibration or sifting action.

An apparatus for dispensing particulate agglomerating solids in accordance with the invention includes a container for holding the particulate solids to be dispensed which has a foraminous discharge disposed at the bottom of the container; an apparatus for applying agitation to the particulate solids within the container to break up the agglomerations to cause the solids to be free flowing through the foraminous discharge; a transporting mechanism disposed beneath the discharge with a top surface along which the solids flow from a receiving area upon which the solids fall upon the application of agitation to the solids in the container to a discharge area having sides and an end from which the solids are discharged, the top surface being substantially flat at the receiving area and being concavely smoothly curved with respect to a reference point above the transporting mechanism in the discharge area to prevent solids from falling off of the sides of the discharge area while causing the solids to maintain a depth of accumulation in the discharge area not substantially greater than the depth of accumulation of the solids in the receiving area when the solids are flowing through the foraminous discharge and being sloped downward from the receiving area to the discharge area; apparatus for applying vibrations to the transporting mechanism for causing the solids to flow from the receiving area to the discharge area; and a controller for causing the activation of the apparatus for applying agitation and the apparatus for applying vibrations during the time which the flow of solids occurs from the container along the transporting mechanism. The concavity of the discharge area preferably is greater at the discharge end than in proximity to the receiving end and smoothly increases from proximity to the receiving end to the discharge end. The concavity of the discharge area should be chosen to not cause the concentration of the flowing solids in the discharge area to a thickness which causes their agglomeration on the transporting mechanism. The apparatus for applying agitation may include a horizontally disposed rotatable member located in proximity to the foraminous discharge to cause the solids to flow upon rotation.

In accordance with this embodiment, while it is preferred that the discharge area should be concave, the invention may be practiced with the discharge area being substantially flat. In either form of the embodiment the power levels of the apparatus for applying vibrations and the apparatus for applying agitation are chosen so that the depth of accumulation in the discharge area is not substantially greater than the depth of accumulation in the receiving area. During operation, the power level of the agitation is chosen to prevent the accumulation in the receiving area of the particulate agglomerating solids in a thickness which causes agglomeration.

In accordance with a further embodiment of the invention, the above-described embodiment may be used to precisely dispense programmed quantities of particulate solids. A balance is provided for repeatedly reading the weight W of any solids within a container disposed on the balance which is positioned for receiving solids discharged from the discharge end of the transporting mechanism. The controller is provided with a microprocessor based control program for controlling the activation of the apparatus for applying vibrations to the transporting mechanism and the apparatus for applying agitation to the particulate solids in the container. The controller causes the activation of the apparatus for applying vibrations as long as $TW-W$ is $>0$, where TW is a desired weight of the solids to be dispensed and causes the activation of the apparatus for applying agitations only when $TW-W>C$, where C is a constant less than TW.

In another embodiment of the invention for dispensing precisely weighed quantities of solids, the controller causes the activation of the apparatus for applying vibrations and the apparatus for applying agitations as long as the quantity $TW-W>0$. When the dispensed amount of solids W is equal to the desired weight of solids to be dispensed TW, the controller deactivates the apparatus for applying vibrations and apparatus for applying agitation to stop the flow of solids from the discharge end of the discharge area of the transporting mechanism.

In a further embodiment of the invention for precisely dispensing weighed quantities of solids, the controller activates the apparatus for applying vibrations and the apparatus for applying agitations with each having a first power level when $TW-W>C$, wherein C is a constant less than TW and TW is a desired weight of solids to be dispensed and with a second power level less than the first power level for the apparatus for applying agitations and the apparatus for applying vibrations when $TW-W\leqq C$ and for stopping the activation of the apparatus for applying vibrations and apparatus for applying agitations when $TW-W$ is equal to 0. Further in accordance with this embodiment of the invention, a mechanism for varying the vertical slope of the transporting mechanism is provided which is controlled by the controller to cause the vertical slope of the transporting mechanism to be reduced when $TW-W\leqq C$.

BRIEF DESCRIPTION OF THE DRAWINGS

FIG. 1*a* illustrates the preferred method for determining if a material is an agglomerating material which the present invention is designed to precisely dispense.

FIG. 1 illustrates an apparatus for dispensing particulate agglomerating solids in accordance with the present invention.

FIG. 2.is a top view of the container of FIG. 1 which illustrates the apparatus for applying agitation to the agglomerating solids.

DESCRIPTION OF THE PREFERRED EMBODIMENTS

Figure 3:
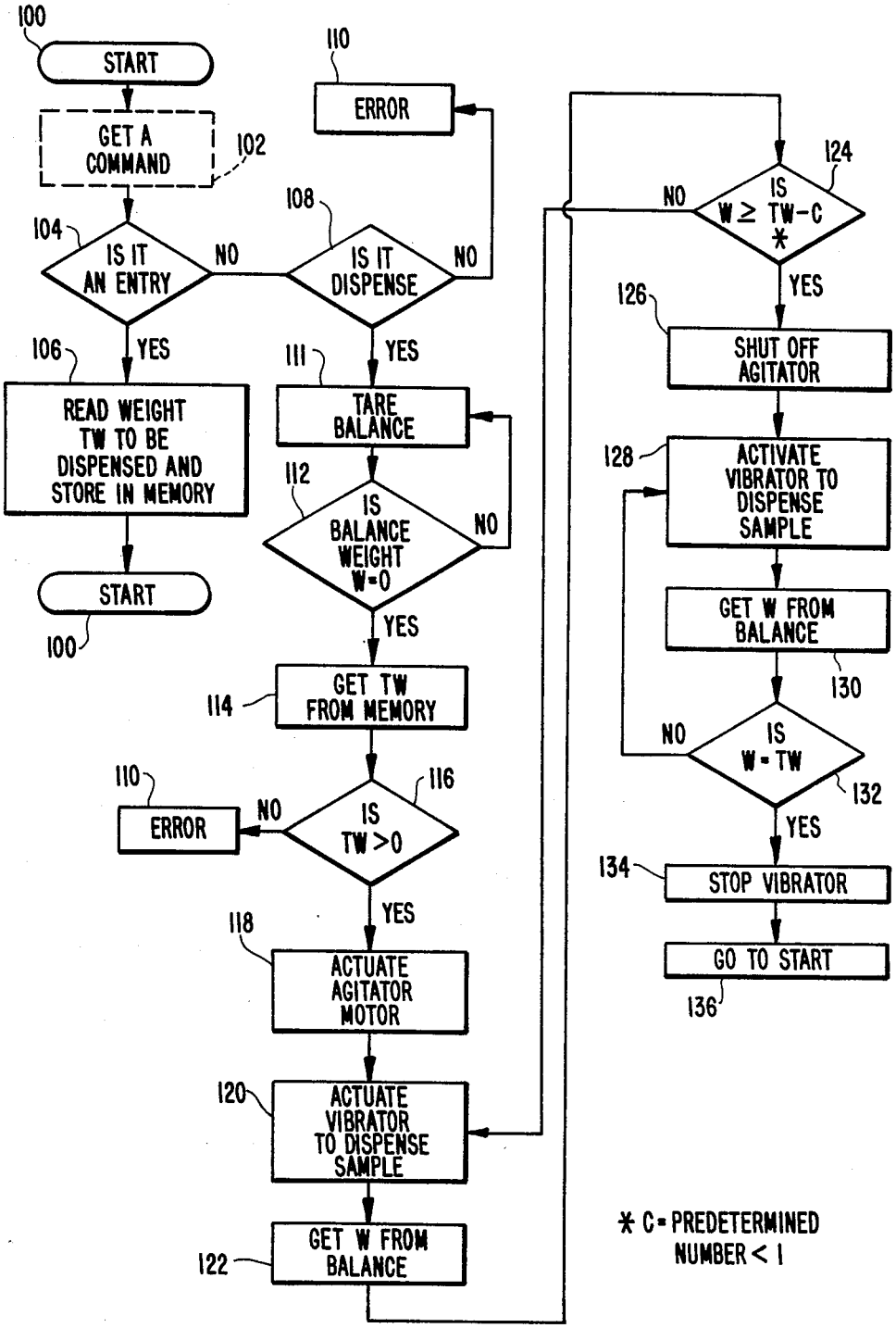
FIG. 3 is a flowchart of a first form of control program used for the controller of FIG. 1 to dispense precisely weighed quantities of agglomerating solids.

The present invention is an apparatus for precisely dispensing particulate agglomerating solids which contain particles which bridge together to form agglomerations which are not easily broken apart. The preferred method of determining if a particulate substance forms agglomerations is by measurement of the angle of repose A of FIG. 1*a*. Particulate substances which have an angle of repose substantially greater than 40° are usually those substances which have flow characteristics which require the usage of the present invention to permit precise dispensing of the solids because of their pronounced tendency to form agglomerations. Particulate substances which have an angle of repose substantially greater than 40° have particles which readily bridge together which are not easily broken apart without the application of agitation or vibration. The angle of repose is determined by pouring the particulate solids into a pile as illustrated in FIG. 1*a* and measuring the angle of repose A as illustrated. Measurement of angle A may be made by any known method. Without limitation, conventional substances which tend to form agglomerates with an angle of repose greater than 40° are corn starch 51°, confectioner's sugar 50°, baking soda 49°, all purpose flour 46° and cocoa 46°. There are numerous other particulate solids which form agglomerates which may be dispensed with the present invention. However, as used in the specification and claims, the terminology "particulate agglomerating solids" is used to describe those substances which had particles which readily bridge together to form agglomerates which are not broken apart once agglomerated without the application of agitation, such as vibration or sifting or other forms of mechanical energy.

FIG. 1 illustrates the preferred embodiment 10 of the present invention. With reference to FIG. 1, the principal elements of the present invention are as follows. A container 12 is provided for holding the particulate agglomerating solids to be dispensed which has a foraminous discharge 14 (FIG. 2) located at the bottom of the container. A transporting mechanism 16 is located below the foraminous discharge upon which falls the particulate agglomerating solids to be dispensed on to a receiving area 18 from which the solids are conveyed to a discharge area 20. The agitator 22 includes an agitator motor 40 and a stirrer 42 having a horizontally disposed section 44 and a vertically disposed section 46. An agitator 22 is provided for breaking apart the particulate agglomerating solids within the container 12. Vibrator 24 contacts the transporting mechanism 16 for applying vibrations to cause the particulate agglomerating solids to be transported from the receiving area 18 to the discharge area 20. Controller 26 controls the activation of the agitator 22 and the vibrator 24. Preferably, the controller 26 has a microprocessor for controlling the activation of the agitator 22 and vibrator 24 to dispense precisely weighed quantities of the particulate agglomerating solids into a container 28. The microprocessor may be any commercial model. The preferred forms of the microprocessor control program are discussed, infra, with regard to FIGS. 3–6. When the present invention is used to dispense precisely weighed quantities of particulate agglomerating solids, a balance 30 having TARE capability such as a model PC 180 or PE 360 manufactured by the Mettler Instrument Corporation of Heightstown, N.J., provides a continuously available BCD output signal (binary coded decimal) which communicates to the controller 26 a signal indicative of the actual weight W of the particulate agglomerating solids which has been dispensed into the container 28 at any instant in time. The microprocessor control program functions to compare the actual weight W of particulate agglomerating solid which has been dispensed with the desired weight TW which is to be dispensed to control the selective activation of the agitator 22, vibrator 24, variation in the power levels applied to the agitator and the vibrator and, finally, the adjustment of the angle of inclination of the transporting mechanism 16 by a vertical actuator 34. The details of the control of these elements is discussed, infra, in conjunction with FIGS. 3–6.

The shape of the top surface of the transporting mechanism 16 is an important aspect of the invention because of the property of particulate agglomerating solids to readily bridge together which interferes with precise flow and dispensing of weighed quantities. The receiving area 18 is substantially flat to prevent the concentration of the particulate agglomerating solids into an area smaller than the discharge area of the discharge 14 to prevent the accumulation of the solids in a layer of a thickness which tends to form agglomerates because of the individual particles bridging together. Under normal operation, the power levels of the agitator 22 and the vibrator 24 are set empirically to match the flow rates of the agglomerating particulate solids through the foraminous discharge 14 with the flow rate of the solids from the receiving area 18 to the discharge area 20. The flow rate from the discharge 14 is substantially constant for each level of agitation of the agitator 22. The power levels required to produce the aforementioned balanced flow rate for different particulate agglomerating solids may have to be varied. The discharge area 20 is provided with a concave curve with reference to a point above the discharge area to preclude the agglomerating particulate solid from falling off the sides 36 during the activation of the vibrator 24. The degree of concavity is preferably smoothly variable between the point in proximity to the receiving area 18 where the degree of concavity is a minimum to the discharge end 38 where the degree of concavity is a maximum. The maximum degree of concavity of the transporting mechanism 16 is chosen for each particulate substance to provide sufficient curvature to prevent the solids from falling off of the sides 36 while causing the solids to maintain a depth of accumulation in the discharge area 20 not substantially greater than the depth of accumulation of solids in the receiving area 18 when the solids are flowing through the foraminous discharge 14. The maximum degree of concavity is determined for the particular solids to be dispensed. Since the transporting mechanism is preferably made from a thin sheet of metal or other flexible material, any suitable mechanism (not illustrated) may be provided for permitting the adjustment of the concavity of the discharge end 38 of the transporting mechanism 16 to achieve the above-described mode of operation.

Figure 7:
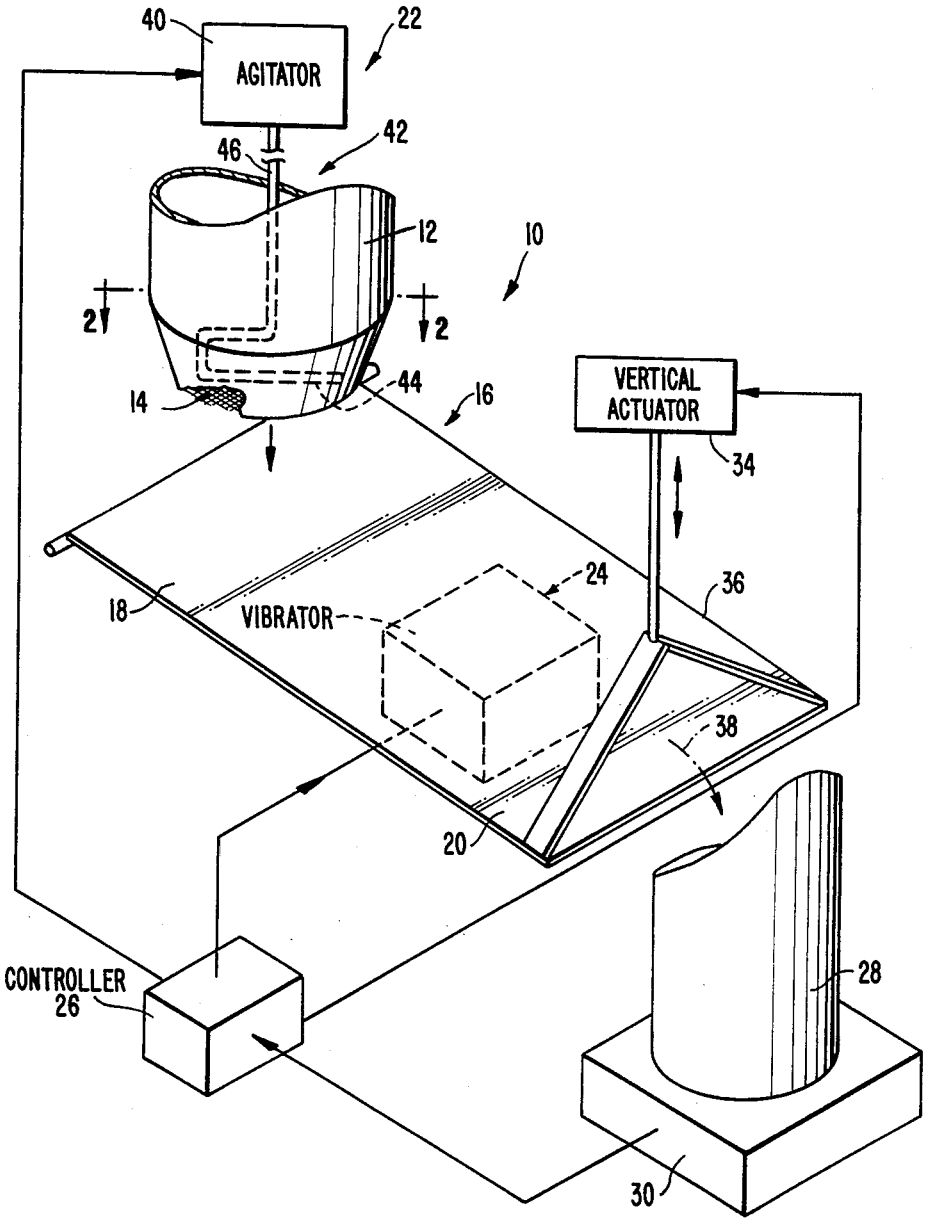

FIG. 7 illustrates a modification of the discharge area 20 of the embodiment of FIG. 1. Like reference numerals in FIGS. 1 and 7 identify like parts.

While preferably the discharge area 20 of the transporting mechanism 16 is concave as described above, it should be understood that the present invention may be practiced with the discharge area substantially flat. The only potential problem with having the discharge area 20 substantially flat is that the width of the discharge area must be wide enough to prevent the particulate agglomerating solids from falling off of the sides 36 instead of into the container 28.

FIG. 3 illustrates a first form of control program for the controller 26 of FIG. 1. It should be understood that the flowchart illustrates the practice of the invention to dispense a precisely metered weight of particulate agglomerating solids TW. The control program starts at starting point 100 and proceeds to point 102 where a command is inputted from the controller 26. There are two possible types of commands which are an entry command which enters the amount of solids TW to be dispensed and an actual dispense command which occurs after the entry of the weight TW of solids to be dispensed TW. The program proceeds to decision point 104 where a determination is made if the entered command is an entry command. If the answer is "yes", the program proceeds to point 106 where the weight TW to be dispensed is read and stored in memory. The program proceeds from point 106 back to starting point 100. If the answer is "no" at decision point 104, the program proceeds to decision point 108 where a determination is made if the entered command is a dispense command. If the answer is "no" at decision point 108, the program proceeds to point 110 where an error flag is set to produce a visible or otherwise perceptible indication of the error condition on the controller 26. If the command is a dispense command, the program proceeds to point 111 where the TARE control on balance 30 is activated which causes the outputting of a zero binary coded decimal output from the balance 30 of the weight of solids within container 28. The program proceeds from point 111 to decision point 112 where a determination is made if the BCD output from the balance 30 is zero. If the answer is "no" at decision point 112, the program loops back to point 111 where the TARE control on the balance is again activated. If the answer is "yes" at decision point 112, the program proceeds to point 114 where the weight TW which has been stored in memory at point 106 is read from the memory. The program proceeds to decision point 116 where a determination is made if the weight TW read from memory is greater than zero. If the answer is "no", the program branches to error point 110 where an error condition is caused to be displayed by the controller 26 in the manner described above with reference to the branching from decision point 108. If the answer is "yes" at decision point 116, the program proceeds to point 118 where the agitator motor 40 is activated to cause the horizontally disposed portion 44 of stirring member 42 to rotate to cause the particulate agglomerating solid to pass through the foraminous discharge 14. The program proceeds to point 120 where the vibrator 24 is activated to cause the dispensing of the sample from the transporting mechanism 16 into container 28.

The program proceeds to point 122 where the weight of particulate agglomerating solid which has been discharged from the discharge area 20 into the container 28 is outputted from the balance 30 as the variable W in BCD form. The program proceeds to decision point 124 where a determination is made if the weight W read out from the balance 30—the quantity TW−C, wherein C preferably is a predetermined number <1. If the answer is "no" at decision point 124, the program branches back to point 120 as described above. If the answer is "yes" at decision point 124, the program proceeds to point 126 where the agitator motor 40 is shut off. The program proceeds to point 128 where the vibrator 24 is activated to continue the dispensing of sample. The program proceeds to point 130 where the weight W is read out from the balance 30 as described above. The program proceeds to decision point 132 where a determination is made if the quantity W is equal to the quantity TW. If the answer is "no" at decision point 132, the program branches back to point 128 as described above. If the answer is "yes" at decision point 132, the program proceeds to point 134 where the vibrator 24 is shut off to stop the dispensing of sample into the container 26. It should be noted that the stopping of the vibrator instantaneously stops the dispensing of sample because of the combination of the slope of the transporting mechanism and the agglomerating characteristic of the solids which produce sufficient friction to instantaneously stop movement of the individual particles. The program proceeds to point 136 where the program loops back to starting point 100.

Figure 4:
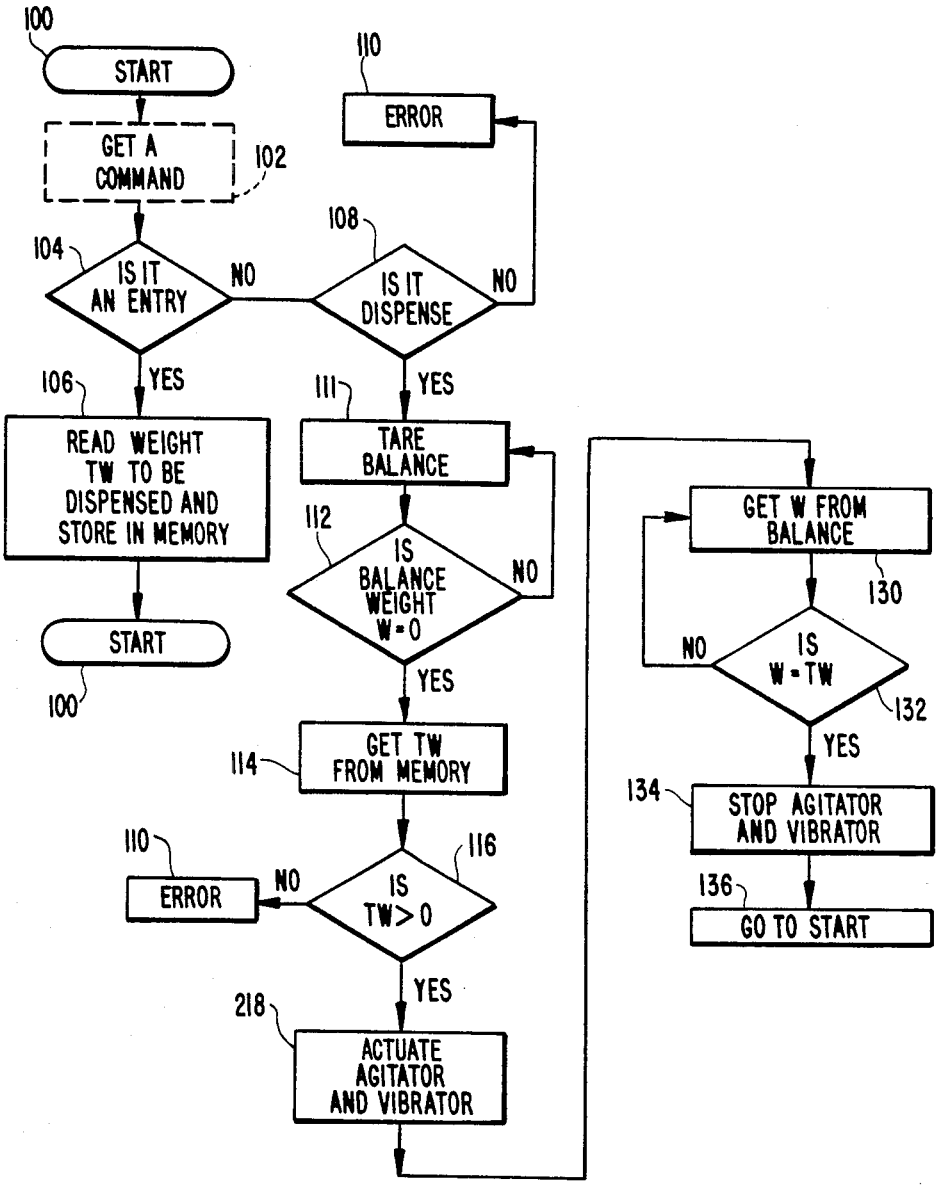
FIG. 4. is a flowchart of a second form of control program used for the controller of FIG. 1 to dispense precisely weighed quantities of agglomerating solids.

FIG. 4 illustrates a modification of the control program discussed above with respect to FIG. 3. Identical reference numerals are used in FIG. 4 to identify parts which are identical to parts in FIG. 3. The principal difference between the control program of FIG. 4 and that of FIG. 3 is that the agitator 22 and the vibrator 24 are simultaneously activated and deactivated in FIG. 4. The activation of the agitator 22 and the vibrator 24 continues from point 218 until the weight W read at point 130 is determined at decision point 132 to be equal to TW. When the answer is "yes" at decision point 132, the program proceeds to point 134 where the agitator and the vibrator are stopped to instantaneously stop the flow of the particulate agglomerating solids into the container 28.

Figure 5:
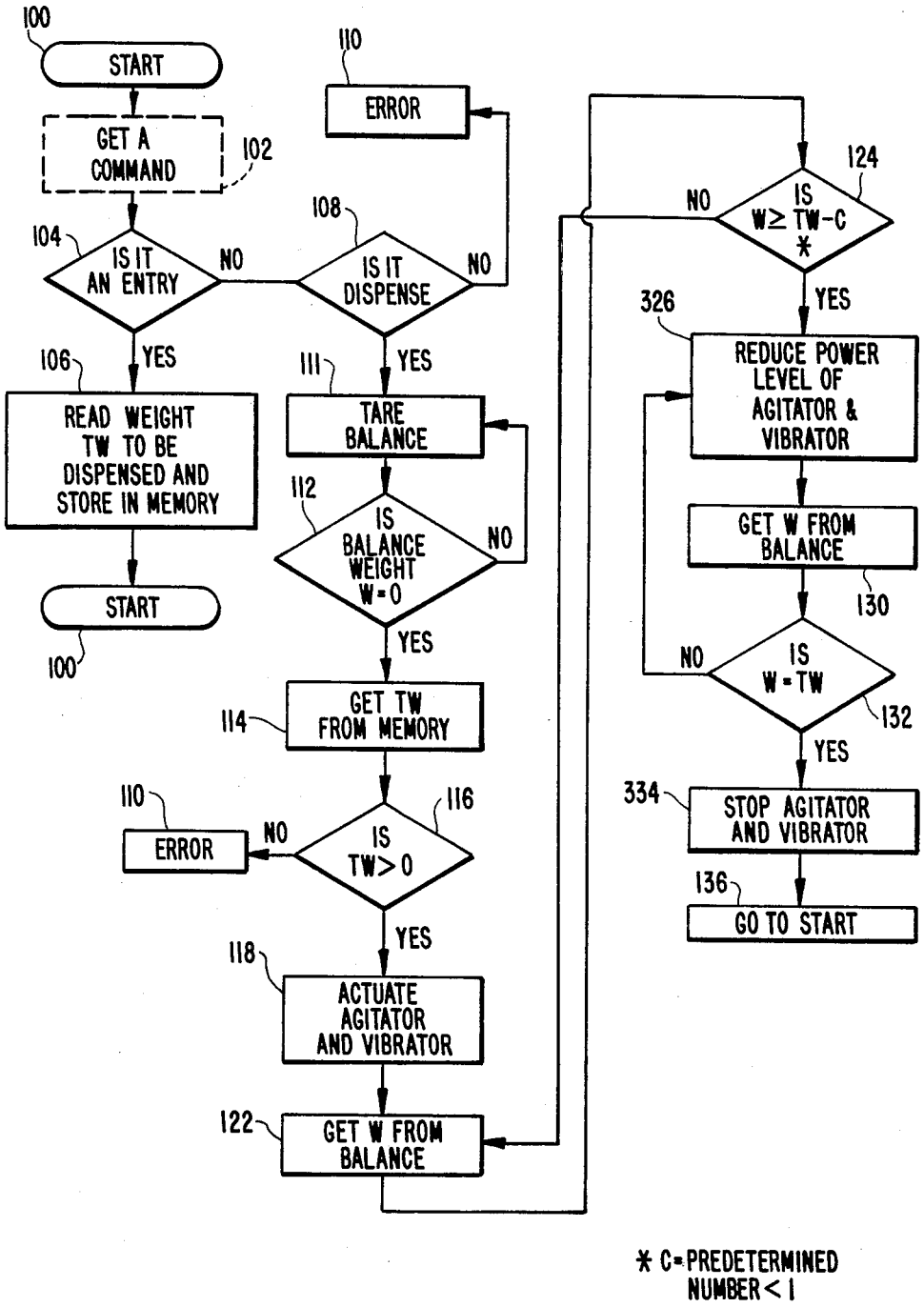
FIG. 5 is a flowchart of a third form of control program used for the controller of FIG. 1 to dispense precisely weighed quantities of agglomerating solids.

FIG. 5 illustrates a modification of the control program of FIG. 4 in which the power level of the agitator 22 and vibrator 24 are reduced when the weight W of particulate agglomerating solids within the container 28$\geqq TW-C$, wherein C is the aforementioned predetermined weight. Identical reference numerals are used in FIG. 5 to identify parts which are identified by the same reference numerals in FIG. 4. The program proceeds from point 118 where the agitator and vibrator are activated to point 122 where the weight W is read from the balance 30. The program proceeds to decision point 124 where a determination is made if $W \geqq TW-C$. If the answer is "no" at decision point 124, the program loops back to point 122 as described above. If the answer is "yes" at decision point 124, the program proceeds to point 326 where the power level of the agitator 22 and vibrator 24 is reduced to a level to reduce the flow rate of solids from the container 12 and along the transporting mechanism 16 to facilitate the precise dispensing of the weight TW to the container 28 by reducing the flow rate so that overshoot in the desired weight TW does not occur. The program proceeds from point 326 to point 130 where the weight on the balance 30 is read. The program proceeds to decision point 132 where a determination is made if the weight which has been read is equal to the desired weight TW. If the answer is "no" at decision point 132, the program loops back to point 326. If the answer is "yes" at decision point 132, the program proceeds to point 334 where the vibrator and agitator are stopped. The program proceeds from point 334 to point 136 where the program loops back to starting point 100.

Figure 6:
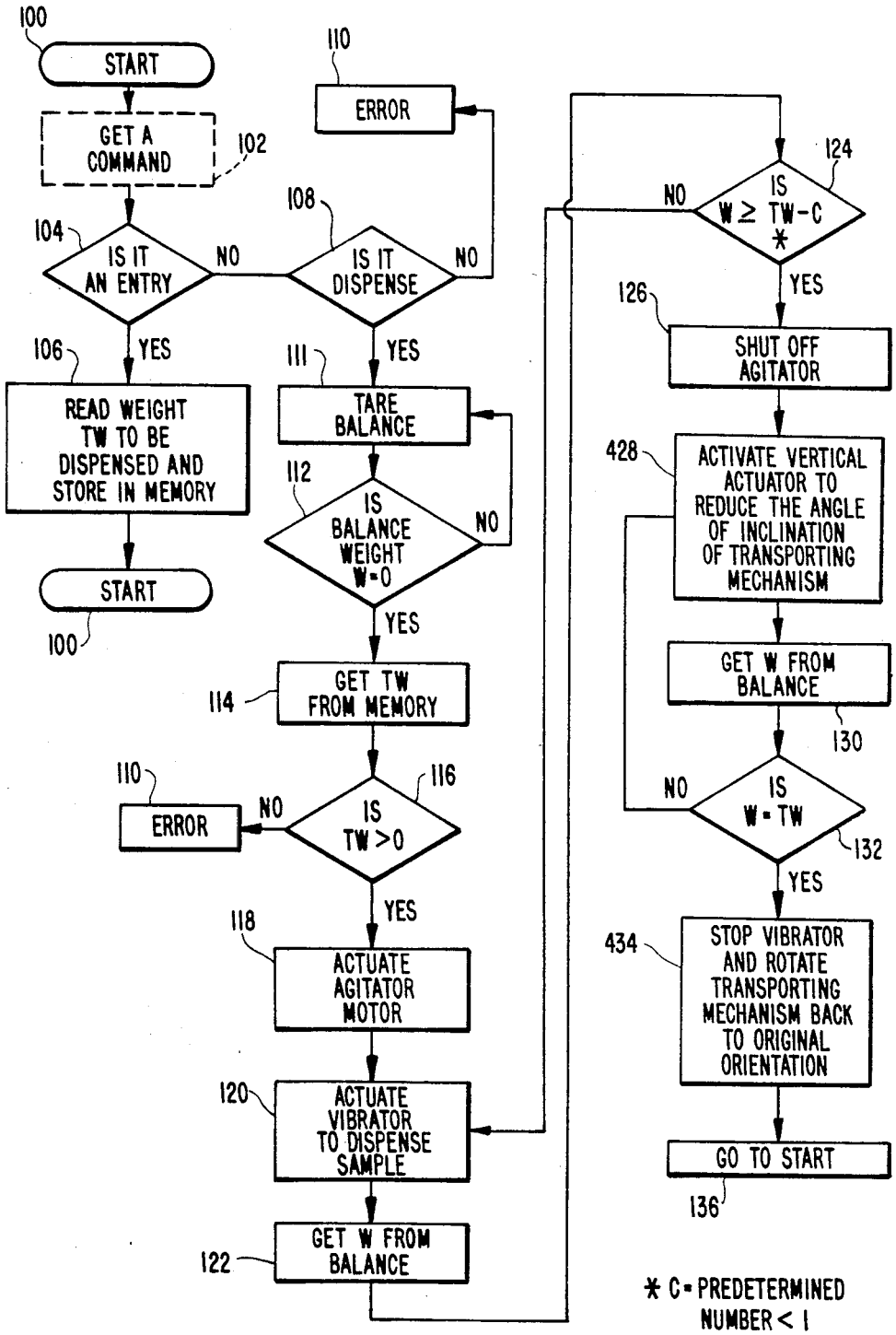
FIG. 6 is a flowchart of a fourth form of control program used for the controller of FIG. 1 to dispense precisely weighed quantities of agglomerating solids.

FIG. 6 illustrates a modification of the control program of FIG. 3 wherein immediately after the stopping of the agitator, the vertical angle of inclination of the transporting mechanism 16 is reduced by the vertical actuator 34 to reduce the rate of flow of solids along the transporting mechanism to facilitate the accurate dispensing of the desired weight TW. Identical reference numerals are used in FIG. 6 to identify steps which are identified by those same reference numerals in FIG. 3. The program proceeds from point 126 where the agitator 22 is shut off to point 428 where the vertical actuator 34 is activated to reduce the angle of inclination of the transporting mechanism 16. The program proceeds to point 130 where the weight W is read from the balance 30. The program proceeds to decision point 132 where a determination is made if the weight W which has been read is equal to the desired weight TW of solids to be dispensed. If the answer is "no" at decision point 132, the program loops back to point 428. If the answer is "yes", the program proceeds to point 434 where the vibrator is stopped and the vertical actuator is activated to rotate the angle of inclination back to the original angle of inclination prior to the execution of step 428. The program proceeds to point 136 where the program branches back to starting point 100.

While the invention has been described in terms of its preferred embodiment with different control programs, it should be further understood that modifications may be made to the control programs discussed above. Specifically, with respect to the embodiments of FIGS. 3 and 6, the power level of the vibrating mechanism may be reduced at the time that the weight of solid W that has been dispensed$\leqq$the quantity TW−C to further reduce the rate of flow to faciliate accurate dispensing of the desired weight of solids TW.

It is useful for precisely dispensing programmed weighed amounts of particulate agglomerating solids to operate the agitator 22 and the vibrator 24 such that the rate of flow of the particulate agglomerating solids from the transporting mechanism 16 is potentially greater than the flow rate from the container 12. A higher flow rate from the transporting mechanism 16 than the container 12 can be achieved adjustment of the rotational speed of the agitator 22 and the power level of the vibrator 24 of the transporting mechanism 16 by known means.

Moreover, numerous modifications may be made to the invention as described above without departing from the spirit and scope of the appended claims. It is intended that all such modifications fall within the claims.

What I claim as my invention:

1. An apparatus for accurately dispensing a programmed weight of particulate agglomerating solids into a receiver which have an angle of repose of approximately 40° or greater comprising:

a container for holding the particulate agglomerating solids to be dispensed having foraminous discharge disposed at the bottom of the container;

means for applying a variable power level of agitation to the particulate solids within the container to break up agglomerations to cause the solids to be free flowing through the foraminous discharge, the means for applying agitation including an element which moves relative to the foraminous discharge and is disposed adjacent to the foraminous discharge so that during activation of the means for applying agitation agglomerating solids are forced through the foraminous discharge at a substantially uniform rate for each level of agitation, the rate of flow being adjustable by variation of the variable power level;

transporting means disposed beneath the foraminous discharge with a top surface along which said solids flow from a receiving area upon which the solids fall upon the application of agitation to said solids to a discharge area from which said solids are discharged, the top surface along which said solids flow being substantially flat from said receiving area to said discharge area for causing the solids to accumulate to maintain a depth on the discharge area substantially the same as the depth of the solids on the receiving area when the solids are flowing through the foraminous discharge, the transporting means being sloped downward from the receiving area to the discharge area;

the means for applying a variable power level of agiation being operated with a power level which prevents the particulate agglomerating solids from accumulating to a depth in the receiving area which causes agglomeration;

means for applying vibrations to said transporting means for causing said solids to flow from the receiving area to the discharge area with the means for applying vibration being operated with a power level which produces a uniform flow rate of particulate agglomerating solids on the transporting means matching the flow rate of particulate agglomerating solids from the container caused by the means for applying agitation; and control means for causing the activation of said means for applying agitation and the means for applying vibrations during the time which the flow of solids occurs from the container along the transporting means and for deactivating the means for applying agitation and the means for applying vibration when the programmed weight of a particulate agglomerating solid has been dispensed into the receiver.

2. An apparatus in accordance with claim 1 wherein the element movable relative to the foraminous discharge comprises a horizontally disposed elongated rotatable member located adjacent to the foraminous discharge which is rotated during activation of the means for applying agitation.

3. An apparatus in accordance with claim 1 further comprising:

a balance for repeatedly reading the weight W of any solids within the receiver which is disposed on the balance in a position for receiving solids discharged from the discharge end of the transporting means; and wherein the control means causes the activation of said means for applying vibrations and the means for applying agitation as long $TW-W$ is $>0$ where TW is a desired weight of solids to be dispersed and stopping the activation of the means for applying vibrations and the means for applying agitation when $TW-W=0$.

4. An apparatus for accurately dispensing a programmed weight of particulate agglomerating solids into a receiver which have an angle of repose of a proximately 40° or greater comprising:

a container for holding the particulate agglomerating solid to be dispensed having foraminous discharge disposed at the bottom of the container;

means for applying a variable power level of agitation to the particulate solids within the container to break up agglomerations to cause the solid to be free flowing through the foraminous discharge, the means for applying agitation including an element which moves relative to the foraminous discharge and is disposed adjacent to the foraminous discharge so that during activation of the means for applying agitation agglomerating solids are forced through the foraminous discharge at a substantially uniform rate for each level of agitation, the rate of flow being adjustable by variation of the variable power level;

transporting means disposed beneath the foraminous discharge with a top surface along which said solids flow from a receiving area upon which the solids fall upon the application of agitation to said solids to a discharge area from which solids are discharged, the top surface along which said solids flow being substantially flat at said receiving area and being concavely smoothly curved with respect to a reference point above the transporting means in said discharge area to prevent solids from falling off sides of the discharge area and extending as a single continuous surface from the receiving area to the discharge area without intersecting any other surfaces for causing the solids to accumulate to maintain a depth on the discharge area substantially the same as the depth of the solids on the receiving area when the solids are flowing through the foraminous discharge, the transporting means being sloped downward from the receiving area to the discharge area;

the means for applying a variable power level of agitation being operated with a power level which prevents the particulate agglomerating solids from accumulating to a depth in the receiving area which causes agglomeration;

means for applying vibrations to said transporting means for causing said solids to flow from the receiving area to the discharge area with the means for applying vibration being operated with a power level which produces a uniform flow rate of particulate agglomerating solids on the transporting means matching the flow rate of particulate agglomerating solids from the container caused by the means for applying agitation; and control means for causing the activation of said means for applying agitation and the means for applying vibrations during the time which the flow of solids occurs from the containers along the transporting means and for deactivating the means for applying agitation and the means for applying vibrations when the programmed weight of a particulate agglomerating solid has been dispensed into the receiver.

5. An apparatus in accordance with claim 4 wherein the element movable relative to the foraminous discharged comprises a horizontally disposed elongated rotatable member located adjacent to the foraminous discharge which is rotated during activation of the means for applying agitation.

6. An apparatus in accordance with claim 4 further comprising:

a balance for repeatedly reading the weight W of any solids within the receiver which is disposed on the balance in a position for receiving solids discharged from the discharge end of the transporting means; and wherein the control means causes the activation of said means for applying vibrations and the means for applying agitation as long $TW-W$ is $>0$ where TW is a desired weight of solids to be dispersed and stopping the activation of the means for applying vibrations and the means for applying agitation when $TW-W=0$.

* * * * *